US007549281B2

(12) United States Patent
Kuwano et al.

(10) Patent No.: US 7,549,281 B2
(45) Date of Patent: Jun. 23, 2009

(54) FIBER YARN AND CLOTH USING THE SAME

(75) Inventors: Kiyotoshi Kuwano, Kusatsu (JP); Ryo Murayama, Komae (JP); Keitaro Nabeshima, Otsu (JP)

(73) Assignee: Toray Industries, Inc. (JP)

( * ) Notice: Subject to any disclaimer, the term of this patent is extended or adjusted under 35 U.S.C. 154(b) by 0 days.

(21) Appl. No.: 10/577,126

(22) PCT Filed: Nov. 1, 2004

(86) PCT No.: PCT/JP2004/016208

§ 371 (c)(1),
(2), (4) Date: Jun. 13, 2006

(87) PCT Pub. No.: WO2005/045108

PCT Pub. Date: May 19, 2005

(65) Prior Publication Data

US 2007/0031664 A1 Feb. 8, 2007

(30) Foreign Application Priority Data

Oct. 31, 2003 (JP) ..... 2003-371726

(51) Int. Cl.
*D02G 3/02* (2006.01)

(52) U.S. Cl. ..... 57/243; 57/244

(58) Field of Classification Search ..... 57/243
See application file for complete search history.

(56) References Cited

U.S. PATENT DOCUMENTS 5,676,795 A * 10/1997 Wizani et al. ..... 162/30.11
5,930,989 A * 8/1999 Nakagawa et al. ..... 57/243

FOREIGN PATENT DOCUMENTS

| | | | |
|---|---|---|---|
| JP | 2001-115347 | A | 4/2001 |
| JP | 2003-113554 | A | 4/2003 |
| JP | 2003-155646 | A | 5/2003 |
| JP | 2003-301327 | A | 10/2003 |

* cited by examiner

*Primary Examiner*—Shaun R Hurley
(74) *Attorney, Agent, or Firm*—DLA Piper LLP (US)

(57) ABSTRACT

In view of the demand to replace wood pulp to preserve forests which is brought about by the recent trend to preserve natural resources from the terrestrial warming or the environmental pollution, this disclosure provides a yarn using cellulose-based filament yarn made from bamboo. This is achieved by a fiber yarn which is a yarn containing a filament of cellulose-based fiber made from a bamboo having a thickness of about 10 to about 600 dtex and number of twist of 0 to about 3,000 T/M.

8 Claims, No Drawings

FIBER YARN AND CLOTH USING THE SAME

TECHNICAL FIELD

This disclosure relates to a cellulose-based fiber yarn made from a bamboo and a cloth using the same which constitutes a woven or knitted fabric or non-woven fabric.

BACKGROUND

Conventionally, as a starting material for cloth such as woven or knitted fabric or non-woven fabric, in natural fiber field, starting materials by cultivation or farming has been used. In the chemical fiber field, it is mostly occupied by cellulose-based regenerated fiber in which natural starting material is used, semi-synthetic fiber, protein-based fiber and synthetic fiber in which coal or petroleum is used as starting material. However, recently $CO_2$ increase due to lumbering forests for producing fibers or the like, or environmental pollution and terrestrial warming due to increase of coal- and petroleum-based industrial waste have become big problems.

For solving these problems and for terrestrial environmental preservation, research and development proceeded to change those starting materials to biomass resources (resources other than petroleum), and not only commercialization of polylactic acid fiber, PLA (polylactic acid) made from starches of corn or sweet potato, but also other developments based on bio-technology have been made rapidly. In addition, to produce fibers by cultivation, a technology for extracting fiber by mechanical methods such as slitting and splitting from bamboo, kenaf or month peach was developed and about to be commercialized. However, in this technique, although staple-fiber can be made, it is impossible to make continuation filament. On the other hand, although it is being tried to make a fiber from lees of soybean for food, it is a technique for making a staple fiber and it has not yet succeeded to make a continuous filament. Also, a fiber yarn is proposed in which Indian bamboo is spun as a cellulose rayon fiber to make a staple fiber, and it is spun to make a yarn, and, by controlling thickness and number of twists of the fiber yarn, tenseness, resilience and recovery from creases are more improved compared to woven or knitted fabric of conventional cellulose rayon fiber. JP-A-2001-115347. However, it has not been tried to take out cellulose from bamboo and make it into filament for fabrics such as woven, knitted and nonwoven fabrics.

Although, there is a publication describing about obtaining a textile by mixing a polyester type synthetic fiber to a staple fiber yarn made from bamboo and it is effective for stretchability and touch, but a filament yarn is not indicated. JP-A-2003-113554.

This disclosure makes it possible to industrially produce a cellulose-based filament by removing impurities such as resin component and ash component to thereby take out the cellulose component with a good purity. And, using the filament made by this new technology, this disclosure makes it possible to make a fabric made thereof such as woven or knitted fabric or nonwoven fabric.

SUMMARY

This disclosure replaces wood pulp and provides a yarn or a cellulose-based filament made from bamboo, or a fabric made thereof. When a bamboo or the like is used as a starting material, there is no environmental load, since the growth of bamboo is fast and its oxygen production and $CO_2$ absorption effect is large and, even if $CO_2$ is produced in the fiber production and in the incineration of garment waste, the $CO_2$ produced is equivalent to that absorbed and fixed from the air during its growth. Furthermore, like conventional wood pulp, it is possible to maintain the high moisture absorption/desorption characteristics of cellulose fiber, an excellent luster, a cold touch brought about by the absorption/desorption characteristics and, in addition, a dry touch brought about by the quality of bamboo cellulose different from the conventional rayon made from wood or cotton linter as starting materials. Moreover, by a composite design in combination with other fiber, it is possible to provide a fabric which has wearing impressions such as sweat absorption/quick drying property, stretchability, etc., or generation of negative ions as a healing effect, and further, increase proofing property, pleat retention property and the capability of home laundry, especially, water system laundry. In addition, it is also possible to provide a sanitary woven, knitted or nonwoven fabric comprising the cellulose-based fiber and a synthetic fiber having an antibacterial characteristic or a system germ characteristic.

Selected aspects of this disclosure include:

(1) A fiber yarn which is a yarn containing a filament of cellulose-based fiber made from a bamboo whose thickness is 10 to 600 dtex and a number of twist is 0 to 3,000 T/M.

(2) A fiber yarn according to (1), characterized in that an $\alpha$-cellulose component content in said filament being 80% by weight or more.

(3) A fiber yarn according to (1) or (2), characterized in that a total content of $\alpha$- and $\beta$-cellulose component in said filament being 90% by weight or more.

(4) A fiber yarn according to any one of (1) to (3), characterized in that said filament is manufactured by a viscose rayon continuous spinning method.

(5) A fiber yarn according to any one of (1) to (4), characterized in that said fiber yarn contains at least 20% by weight of said filament and other fiber is at least one selected from the group consisting of a natural fiber, a regenerated fiber, a semi-synthetic fiber and a synthetic fiber.

(6) A fiber yarn according to any one of (1) to (5), characterized in that said cellulose-based fiber is made from a biomass resource as raw material.

(7) A fiber yarn according to any one of (1) to (6), characterized in that said filament and said other fiber are made composite by a method selected from doubling and twisting, intersection twist, covering, filament mixing, false twisting and spinning intersection twist.

(8) A cloth characterized in that it is a woven or knitted fabric or a nonwoven fabric using the fiber yarn described in any one of (1) to (7).

DETAILED DESCRIPTION

By making woven or knitted fabric or nonwoven fabric with monofilament yarn or multifilament yarn of a cellulose-based filament made from a natural or cultivated bamboo, filament in the filament yarn is in a straight condition and becomes rigid by twisting and therefore, compared to a spun yarn of staple fiber made from a bamboo, it excels in tenseness, resilience, or drapability of textile structure. Moreover, compared to textiles using rayon filament made from conventional wood pulp and cotton linter, the fabric has an excellent effect such that it exhibits a particular quality in dry touch, resilience and drapability based on its basic quality. Furthermore, it is possible to provide textiles such as knitted, woven or nonwoven fabric in which a composite yarn with other natural fiber, chemical fiber such as cellulose-based, synthetic fiber staple, spun yarn or filament. The textile has effects such that, when it is put on, there is no sweaty feel by absorption/ desorption; there is no tacky feeling by sweat absorption, there is no feeling of oppression by stretch following body motion, or there is a healing effect by generation of negative ions, although it is not easily realizable. Furthermore, it has increased proofing property, pleat retention property and capability of home laundry, especially, water laundry. In addition, it has an anti-bacterial characteristic or a system germ characteristic. Moreover, in manufacture and disposal of the material for garments and garments goods, the fiber yarn can be developed into a material for garments and garments goods which can satisfy the demand that an environmental load can be lessened. From the application of wear near skin, such as underwear and dress shirts for casual application or relatively outer wear such as woman's and gentleman's jacket, trousers, or jeans etc., it can be used preferably. Moreover, since it has these properties, it is preferably applicable also as sports garments, work wear for the medical field, and care garments. Further, it is applicable also as an interior application, such as an outer cloth for futon, a sheet, a curtain, and a cover sheet of chair.

The yarn containing the cellulose-based filament made from bamboo is used. What is necessary is to contain the cellulose-based filament made from bamboo and, of course, a filament consisting of 100% of the cellulose-based filament made from bamboo is included in the filament. It is preferable, for exhibiting the effect, that the cellulose-based filament made from bamboo is contained at 20% by weight or more in the bamboo containing filament yarn.

The cellulose-based filament made from a bamboo means, unlike the chemical fiber which uses wood pulp or cotton linter pulp as a raw material, a filament made by making a pulp from a bamboo, refining the pulp to obtain cellulose, spinning the cellulose to obtain a fiber. Although it has not been known that a continuous filament can be industrially obtained by using a bamboo as a raw material and by dissolving and spinning it, we made it possible by refining it in the stage of bamboo pulp.

So-called bamboo is also included in the bamboo. The classification of bamboo and so-called bamboo is described in "knowledge of bamboo": written by Hiroshi Muroi, the first edition published on May 20, 1977 by Chiin Shoin.

Conventionally, most of 350 sorts of bamboo grown in China can be used for manufacturing pulp for paper, but second or third grade of jichiku, ouchiku or suichiku in Chinese name which are naturally grown or cultivated widely and abundantly around Sichuan of China can preferably be used. These bamboos are cut down and their parts with especially high impurity content such as stems, branches and leaves are removed, and are made into chips by physical and mechanical action, and then they are made into a pulp as a fiber manufacturing raw material.

The filament can be obtained with the conventional manufacturing technology for the chemical fiber. A regenerated fiber obtained by the viscose process or the cupro ammonium process, a purified cellulose fiber obtained by an organic solvent spinning method, a cellulose acetate semi-synthetic fiber, and a cellulose-based fiber obtained by thermal plasticization and melt spinning of cellulose are preferably used. Here, regarding manufacture of the regenerated fiber by the viscose process, the conventional wet spinning method, in which a viscose spinning solution is made using alkali xanthate and carbon disulfide by using wood pulp or cotton linter pulp as a raw material, and the obtained spinning solution is spun into a sulfuric-acid bath to thereby obtain a fiber, is also applied.

In manufacture of the filament, it becomes possible to obtain a monofilament or multifilament with thin single fiber fineness by using a bamboo for pulp, refining the pulp further, reducing the content of the cellulose of low molecular weight, pentosan, lignin, pitch and ash, and making the α-cellulose content of primary pulp (pulp made from bamboo as a raw material by the pulp process by chemical or mechanical method) to 85% by weight or more. Regarding the pulp made from wood or cotton linter for conventional cellulose-based fiber such as rayon, according to the description in the item of dissolved pulp for rayon from P179 of the Chemical Fiber Handbook (edited by Society of Fiber Science and Technology, Japan and published by Maruzen Co., Ltd. on May 28, 1963), α-cellulose content is specified as 91.8% or more by JIS standard, and the quality standard of the pulp for cuprammonium rayon is 96% or more. However, about the pulp made from a bamboo, the α-cellulose component content of the industrially manufactured pulp which is used for fiber manufacture has not been publicly reported and is not clear.

The manufacture method of the cellulose-based fiber filament made from bamboo is explained hereunder.

When bamboo pulp for paper manufacture is used as a raw material with the same process conditions as the case where wood pulp and a cotton linter are used, fiber strength is low and satisfactory fiber performance cannot be obtained, since the α-cellulose component content of the bamboo fiber is low and the contents of β-cellulose, other low molecular weight celluloses, pitch and ash component are high. Accordingly, spinnability is not good, since the polymerization degree and crystallinity may be low. Spinning filament was tried by selecting the kind of bamboo, and using a pulp capable of manufacturing staple fiber in which the contents of low molecular weight celluloses, pitch and other impurities were decreased, but spinnability was bad due to fiber breakage at spinning and industrial production was impossible. It was found that the bamboo pulp can be spun into filament by increasing the α-cellulose content to 87% by weight or more by selecting the kind of bamboo, improving conditions for manufacturing pulp and fiber, and refining the material at the stage of pulp.

During our research, to compare the structure of the viscose rayon filament made from bamboo pulp and the viscose rayon filament made from conventional wood pulp or conventional cotton linter, thermogravimetric analysis, component analysis by X-ray fluorescence, crystallinity evaluation with the crystal structure parameter by wide angle X-ray intensity distribution measurement, etc. were conducted. Since the crystallinity of the bamboo rayon fiber is lower, it was presumed that there was a difference between cellulose components of the filaments, and that the difference brings about the difference of performances of the woven or knitted fabrics of bamboo fiber and of the fiber made from conventional wood pulp or cotton linter. Therefore, we compared the content of α-, β-cellulose, other low molecular weight cellulose, residual pitch and others, and as a result, it became clear that the viscose rayon filament made from the bamboo cellulose has low content of α-cellulose component compared with the filament made from wood or a cotton linter cellulose, and there is a large content of γ-cellulose, other low-molecular-weight celluloses, impurities, etc. By this measuring method, it is believed that the reason for that the content of the α-cellulose component of the filament is low is because, in the viscose process in which a strong alkali and sulfur dioxide reacts, the relatively low molecular weight component in molecular distribution of the α-cellulose component is further decomposed into a lower molecular weight due to the chemical effect of the molecular weight adjustment in the aging process and due to the use of the viscose spinning solution of alkali xanthate. Because the content of β-cellulose component in bamboo is high, it is believed to further decompose into low molecular weight and content of α- or β-cellulose decreases.

As such viscose wet spinning method, although there are centrifugal type spinning and continuous spinning methods, the continuous spinning method capable of making fiber thin by drawing is preferable because its molecular orientation is good to thereby improve fiber property, and excellent in uniformity of dyeing. In addition, a centrifugal spinning method, so-called "cake winding" method is insufficient in drawing effect because the distance of spinneret and pot cannot be freely changed. And, the α-cellulose content of the bamboo filament is low compared to conventional rayon in which wood pulp or cotton linter is used. For those reasons, in the centrifugal spinning method, the filament is easy to be affected by the difference of winding tensions between inner and outer layers, to thereby cause difference of dyeing ability between winding layers and it becomes necessary to use layers separately which is inconvenient.

JIS Handbook 32 Paper and Pulp 2004 were referred to regarding measurement of the content of α- and β-cellulose, and the content of other components. In the item g) Property and Test of Pulp Paper and Cardboard, of the handbook, the term "α-cellulose" is defined as "The component which remains without dissolving when pulp or cellulose fiber is treated with 17.5% sodium-hydroxide solution and then diluted to 10%. Note: This content serves as a criteria of judging quality of sample. Refer to JIS P8101 and JIS P90002". On the other hand, regarding the term "β-cellulose", it is described as "The component which reproduces when the filtrate of pulp or cellulose fiber is neutralized with acetic acid. Note: Refer to JIS P8010". Moreover, the Test Method for Pulp for Dissolution specified in JIS P 8101-1957 indicated by the above-mentioned Chemical Fiber Handbook edited by the Society of Fiber Science and Technology, Japan was also referred to. In consideration of these, as samples, filaments made by the method of viscose process were evaluated by the methods described in Examples.

In view of good spinnability of bamboo pulp made from bamboo, and in view of processability capable of being used for woven or knitted fabric or nonwoven fabric, and in view of product performance, it is preferable that the strength/elongation of the filament is 1.5 cN/dtex and 15% by weight or more. To satisfy it, it is preferable that α-cellulose content is 80% by weight, more preferably, the total content of α-cellulose and β-cellulose is 90% by weight or more. The α-cellulose contributes to the toughness of fiber such as strength and elongation and the content of β-cellulose and other component of which molecular weight is smaller than α-cellulose contributes as a component to decrease fiber crystallinity. By increasing the low molecular weight component in a range of fiber performance capable of being made into woven or knitted fabrics, it becomes possible to impart a new property which is different from that obtainable from the filament made by conventional wood pulp. As those new effects, since the low molecular weight component contains an antibacterial component, it decreases crystallinity, excellent characteristics in the points of, such as touch, absorption/desorption property, dyeability, negative ions and cool touch, can be obtained.

The filaments made from wood pulp and bamboo pulp, respectively, were dyed in the same bath using direct dye Kayarus supura Blue BWL which is classified as C (poor level in dyeing uniformity) in the SDC classification (J. Soc. Dyers. Colourists. 64. 145 (1948)) under the following conditions. The fibers were dipped into the bath at 50° C. and the bath temperature was raised to 90° C. in 10 minutes. The fibers were washed with water after 20 minutes. The dye concentration was 0.5% owf, bath ratio was 1:200 and $Na_2SO_4$ concentration was 10 g/l. Surface dyeing concentration K/S of the fiber was measured after dyeing. K/S means $(1-R)\times 2/2R$, and R means the spectral reflectance at the maximum absorption wavelength. Measurement of K/S was performed with the D65 light source and 10-degree visual field. K/S was 2.69 for the filament made from bamboo and 1.81 for the filament made from wood pulp and the result indicated the structural difference based on the difference of α-cellulose contents.

The bamboo containing filament yarn may be constituted of either of monofilaments or multifilaments. For textiles, the filament may be used alone or as a composite yarn or as a mixed filament yarn. As for the thickness of the yarn, 10-500 dtex is preferable when used alone, and 30-600 dtex is preferable when used as a composite or as a mixed filament yarn. For a garments application, 450 dtex or less is suitable. In the case of a monofilament, 10 to 50 dtex is preferable, and in case of a multifilament, it is preferable that single fiber fineness is in the range of 1 to 20 dtex, since cellulose-based fiber is easy to become a fluff and it is necessary to secure high processability.

The number of twists needs to be 0 to 3,000 T/M. To make a woven or knitted fabric or a textile having excellent glossy appearance which is characteristic to cellulose fiber, 0 T/M (non-twisted) is preferable. Since fluff may be generated at weaving in the case of multifilament. It is preferable to carry out sizing in such a case. When not performing sizing, it is preferable to choose conditions by adjusting single fiber fineness or total fineness, and additionally imparting low or middle twist of 300 to 1,000 T/M to obtain a required glossy appearance. In the knitting process, since there is less friction than in the weaving process, the fiber yarn can be used without twist, but it is preferable to impart a low twist of about 100 to 300 T/M. To impart dry touch, tenseness, resilience and drapability to the woven or knitted fabric, it is preferable that the additional twist number is 1,000 to 3,000 T/M. In general, cross-section configuration of cellulose-based filament differs according its production method. In a viscose or acetate process, it is like a rias type coast and in copper ammonia and organic solvent spinning it is generally a round cross section. Although a variant cross-section configuration is possible by the shape of a spinneret, it is preferable to decide the number of twist according to required effectiveness, since the effect of twist differs greatly according to the cross section configuration. In the case of a cellulose-based fiber, in general, it swells in the presence of alkali or the fiber structure changes by chemical change. However, since imparting drapability by hydrolysis like in case of polyester is not expected, it is preferable to choose suitably the number of twists and the density of woven or knitted fabric. Moreover, in case of the additional twist number of the cellulose-based filament is in highly twist region of 2,000 to 3,000 T/M, in dyeing and finishing process for the woven or knitted fabric, the apparent twist number increases due to the volume expansion in wet condition. The expansion ratio will be 20 to 30% in the dry state, and due to the increase of the twist number by the volume expansion and because the cellulose fiber is not thermoplastic, a big untwisting stress generates to cause a structural change, and resulted in manifesting shibo (numerous tiny unevenness). That is, it contributes greatly to the products which have yoryu georgette crepe or crepe. In addition to the dry feeling of the cellulose fiber made from bamboo, a touch by a synergistic effect of twist structure and the uneven structure is suitable for materials for spring and summer applications. Furthermore, with effects of antibacterial or cold touch, the possibility of imparting new additional value increases. Moreover, in the case of the cellulose-based continuous filament yarn made from bamboo or so-called bamboo, although it changes somewhat with processes, as for the point that the stretching behavior of the fiber by a load differs greatly in the presence of water, especially in a damp or wet condition, it is in the same trend as that of the cellulose-based fiber made from cotton linter or wood pulp. It is preferable to control humidity and water content in the process of making woven or knitted fabric or nonwoven fabric.

When the viscose rayon process is utilized as the manufacturing process of the cellulose-based filament, color difference of 1.0 or more as a difference of the dye affinity evaluation E value, ΔE, may occur between inner and outer layers of the rolled-up layers in the winding pot and the quality of the dyed fabric may not be good. In particular, when making it into a composite yarn with other fiber, since it is difficult to classify them and use separately, it is preferable to use the filament made by the continuous spinning method.

When using the cellulose-based filament as textiles, such as a woven or knitted fabric or a nonwoven fabric, to cover its faults while taking advantage of its characteristics, it is preferable to use it in combination with other fibers to make a composite. In this case, to exhibit effects of moisture absorption/desorption property, antibacterial property, dry touch, tenseness, resilience, cold touch, and further, generating negative ions, it is preferable to contain 20% by weight or more of the cellulose-based filament, still more preferably, 30% by weight or more. To impart better antibacterial property, moisture absorption/desorption property and cold touch, although it depends on other components used in combination or in the textile structure, it is also preferable to contain 50% by weight or more. For example, in the case of imparting moisture absorption/desorption property, and when regenerated filament is made from bamboo made by the viscose process or the cupro ammonium process, it is preferable to make a woven or knitted fabric or nonwoven fabric made of 100% of such filament, and in such a case, 8-9% as ΔMR of the textile can be obtained. In the case of blend ratio of this cellulose-based fiber is changed, absorption/desorption characteristics is proportional to that blend ratio. If mixed fiber is a polyester type, since the polyester type fiber has almost no moisture absorption property, when the filament is mixed 50% by weight, ΔMR becomes about 4-4.5%. Usually, the level felt that moisture absorption/desorption characteristics are comfortable at the time of wear is 2% or more, and it is preferable also from this point, too, that a cellulose-based filament is 20% by weight or more in fiber yarn. The absorption/desorption property does not depend on how to mix the fiber since it depends on movement of moisture, but as to cold touch feeling, since it is a feeling by directly contacting skin, it depends on the structure or composite state of the fabric and it is preferable to design textiles upon confirming data rather than the blending ratio.

As methods for making the composite yarn, conventionally known methods such as combination twist in which two or more of said filaments are doubled and twisted, intersection twist in which said filament is doubled with other filament or spun yarn and twisted, covering in which polyurethane or other spandex yarn is passed through a hollow spindle as a core and the filament is overfed and twisted, filament mixing in which the filament is doubled with other fiber and interlaced by compressed air or a composite false twisting by multi-feeding said filament to false twister, can be used. However, the cellulose-based filament made from bamboo has characteristics of low strength and low shearing stress to become a fluff, and accordingly, it is preferable, especially in case of multifilament, to be handled carefully under milder conditions than those for the conventional synthetic fibers. In particular, it is preferable, for making a composite yarn by air interlacing, to reduce air pressure very low; for making composite yarn by machines such as doubling machine, doubling and twisting machine or double twister, to make curvature of the lot, etc., of the yarn path low, or as straight as possible; and to reduce the number of guides as much as possible.

The cellulose-based fiber made from a bamboo has antibacterial performance based on the raw material. The antibacterial component is affected by chemicals used and heating temperature in production process. In the case of viscose rayon process, the antibacterial property is influenced by the heat for increasing α-cellulose content and removing impurities by treatment with sodium hydroxide or the like. In addition, although the bamboo pulp is made thermoplastic by adding ethylene glycol to change it into melt-spinnable thermoplastic polymer, the antibacterial property often decreases by the effect of heat at the melt spinning. For making the system germ activity value of 2.2 or more so that the antibacterial level passes the SEK standard, it is preferable to design the yarn in consideration of composite ratio, composite type and its structure. To maintain this natural antibacterial property also after washing, it is also preferable to add a chemical having antibacterial effect in dyeing or finishing process. It is also preferable to compound the quinine-based antibacterial component obtainable by ethanol extraction from bamboo or the antibacterial component obtainable by separating from bamboo vinegar liquid which is taken out by compressing bamboo, to the raw material of the fiber, or to process it into a textile in dyeing or finishing process. On the other hand, the antibacterial property may be imparted by compounding acetylated chitosan which is conventionally used as an antibacterial agent into the spinning liquid, or by processing the obtained yarn or woven or knitted fabric with the antibacterial agent.

As for the above-mentioned fiber yarn, it is preferable that the cellulose filament and other fiber are made into a composite yarn by a method selected from doubling and twisting, intersection twisting, covering, filament mixing, false twisting, spinning intersection twisting, etc. Although the fiber to be combined is not limited in terms of material or type, it is preferable to choose the material which can exhibit the effect of the cellulose-based filament. For example, although woven or knitted fabric of 100% of cellulose-based fiber yarn can be given a shrink-proofing effect by resin treatment in dyeing or finishing process, such as with melamine type resin or glyoxal type resin, the resin treatment may also cause hardening of touch and a bad influence on the environment by the existence of formalin in the resin. Therefore, to provide shrink-proofing property without resin treatment, making a composite with polyester fiber is also preferable. Moreover, cellulose-based fiber yarn has low wet strength and there is no stretchability in woven or knitted fabric, but by making a composite with a polyurethane-based spandex fiber or a conjugate fiber using polytrimethylene terephthalate-based polymer, or a conjugate fiber of 100% polyester-based polymer, it becomes possible to impart stretchability to the cellulose-based fiber yarn and improvement in strength also becomes possible. When considering the environment, it is preferable to make a composite yarn with the raw material fibers, such as polylactic acid fiber, cotton, hemp, silk, wool, regenerated fiber which uses cotton linter as the raw material.

The cellulose-based filament preferably consists of a biomass resource (non-petroleum resource) for the environment.

The raw yarn to be made into a composite, may be any one of cotton, hemp, wool, silk, spun yarn in which staple fiber of regenerated fiber or semi-synthetic fiber is used, or filament of silk or chemical fiber. It can be a combination in which, as far as the characteristics and effects of the respective fiber can be exhibited in the woven or knitted fabric or nonwoven fabric obtainable by making the bamboo fiber composite.

Next, the constitution of the textile using the filament made from bamboo is explained.

As the woven fabric, it may be that in which both of warp and weft are constituted by the filament or the composite yarn, or may be that in which only warp or weft is constituted of the filament. The woven structure can be chosen without limitation including publicly known structures. Regarding warping, sizing, supra sequence beaming, etc., in the weaving process, they can be applied in the same conditions as applied to conventional cellulose-based chemical fiber, for example, rayon yarn, acetate yarn, or Bemberg yarn. In particular, in the sizing, it can be carried out by using a starch-based or a polyvinyl alcohol-based paste and by choosing conditions suitably Since shear strength is low as its characteristic, it is preferable to treat the yarn so that no fluff due to friction is produced. In addition, in tensile strength/elongation characteristics (S-S curve) under moisture absorption or in wet, because the yielding point of stress-strain decreases as humidity increases, the humidity condition of each room of the weaving process is set to the standard condition (20° C., 60%) and the weaving is carried out. Regarding the selection of weaving machine, it is a rapier or an air jet in general, and it is preferable to use a water jet only in the case in which a composite ratio of the cellulose-based fiber is low. In the case of woven fabric in which the filament yarn is used alone, although basic woven fabrics of such as plain structure, e.g., taffeta, habutae, or three dimensional structure, e.g., twill, satin have wide application for garments such as lining, formal wear, shirts, blouse, or for other materials such as curtains, wrapping cloth and ribbon tape. In addition to that, by making composite woven fabrics with other natural fibers or chemical fibers, physical properties and appearance can be improved and can be applied in wider uses.

Regarding knitting, any of circular knit, weft knit and warp knit can be applied without limitation. What is necessary is just to use a yarn according to the design factor of cloth or fabric corresponding to its application. Like weaving process, it is preferable to set up the condition so that it does not damage quality by a fluff and yarn breakage caused by the strength/elongation characteristics and shear stress characteristics in dry and wet conditions.

In the manufacturing method of a nonwoven fabric, although suitable conditions can be chosen according to the fiber used, most preferable method is span bond method, and it can be made into cloth by needle punching or water punch interlacing to the web.

Regarding dyeing, it can be carried out according to the procedure for conventional cellulose-based fiber such as rayon, Bemberg or acetate. The performances in dyeing process such as swelling and decrease of strength in the existence of alkali are almost the same as those of the conventional cellulose-based fiber, and dyeing method, selection of machine and other condition, etc., can be tried and decided, if necessary.

EXAMPLE

Hereafter, our yarns are explained with reference to Examples. However, the description is not limited to these examples.

<Evaluation Method>

Measurement of the α-cellulose content, β-cellulose content, content of a low molecular weight component and others was performed by the following method. Measurements relating to weight change depending on moisture absorption were carried out in the standard room conditioned to 20° C., 65%. Other treatment such as heating was carried out in an ordinary chemical laboratory. Average value of two samples was used.

(1) Defatting of Fiber

Using ethanol benzene mixed liquid (mixing ratio 1:1), Soxhlet's extraction of 4 hours was performed.

(2) Separation of α-Cellulose

About 1 g of absolutely dried fiber is immersed in aqueous solution of 17.5% sodium hydroxide (bath ratio: 1:100) for 2 hours at room temperature. The content is filtered by a glass filter, washed with water, neutralized with acetic acid and then weighed after absolute drying. 150 mm of "ADVANTEC2" (made by TOYOROSHI KAISHA LIMITED) is used for the filter paper.

(3) Separation of β-Cellulose

The filtrate at the time of α-cellulose separation and the washing liquid before neutralization are collectively set to 800 mL, and 40 mL of 30% acetic-acid solution in water is added to this, and it is heated slowly (the beaker containing the solution is put into another container into which the boiling water was put to heat it indirectly). The beaker after heating is taken out and β-cellulose is made to reproduce and condense. About 2 hours after the liquid becomes transparent, it is filtered through a filter paper, washed with water, absolutely dried and weighed.

(4) Other Components

It is determined by subtracting α- and β-cellulose from the original fiber weight.

The quality evaluation in the examples was performed by the following method.

[Hygroscopicity (ΔMR)]

$$\Delta MR\ (\%) = MR_2 - MR_1$$

Here, $MR_1$ denotes the moisture absorption (%) when leaving it for 24 hours from an absolute dry condition to the atmosphere of 20° C.×65% RH, and it is the condition in wardrobe, i.e., namely equivalent to the condition before wear. On the other hand, $MR_2$ denotes the moisture absorption (%) when leaving it for 24 hours from an absolute dry condition to the atmosphere of 30° C.×90% RH, and it is almost equivalent to the condition in the clothes in an exercise.

ΔMR is expressed with the value which subtracted the value of $MR_1$ from $MR_2$ and it is equivalent to how much moisture in clothes can be absorbed when it is put on during exercise. It can be said that it is more comfortable as the ΔMR value increases. Generally, it is said that ΔMR value for polyester is 0%, for nylon, 2%, for cotton 4% and for wool 6%.

[Antibacterial Property]

The standardized test method was used for the evaluation method, and as the test fungus, clinical isolate of yellow *staphylococcus aureus* was used. In the test method, the above-mentioned test fungus is poured into sterilization test cloth, measured the number of the fungus after 18-hour culture, determined the number of the fungus over the initial number of the fungus, and followed the following criteria.

In the condition of log(B/A)>1.5, log(B/C) was made into the bacteriostasis activity value, and 2.2 or more were considered as success. Here, A1 denotes number of fungus of unprocessed article collected just after inoculation, B1 denotes number of fungus of the unprocessed article after 18 hours culture, C1 denotes number of fungus of the processed article after 18 hours culture.

[Number of Generated Ion]

Measuring device: AIR ION COUNTER IC-1000 (made by Alpha LAB (U.S.))

Measuring condition: room temperature of 20±1° C., humidity of 50±3%, room size 3 m×5 m×5 m Measuring-time 10 seconds, suction volume 12 L/min and sample vibration cycle 3 cycles/second Sample size 30 cm×20 cm Evaluation result: average number of generated ion in 10 seconds after start of measurement (piece/$cm^3$)

It is indicated in a negative value when a negative ion is generated and a positive value when a positive ion is generated. The total of the negative and positive values is considered as the number of generated negative ions. −1000 pieces/$cm^3$ is considered as success.

Example 1 and Comparative Examples 1, 2

A repulped raw material with a high content of α-cellulose component was prepared by making a pulp from a bamboo of China, and further refining the pulp by immersing it in caustic soda, and then mashing and refining. Using the repulped raw material, a multi-filament yarn of 130 dtex-30 rayon filament was spun by centrifugal spinning to thereby prepare a cake of 525 g in weight. As comparisons, a multi-filament yarn of 120 dtex-30 made from cotton linter pulp and made by centrifugal spinning and a multi-filament yarn of 84 dtex-24 made by the continuous spinning process were prepared. The obtained filament yarns of the centrifugal spinning, the refined cake, and the cheese made by the continuous spinning were inspected. Although it was practically equal concerning surface irregularity when the filament yarn made from cotton linter pulp and the filament yarn made from bamboo pulp were compared, but as a result of observing the cross sections, the filament made from bamboo has slightly flat cross section and its white color was a little bit yellowish. The result of the physical properties measured is shown in Table 1.

The strength of the multi-filament yarn made from bamboo was low as compared with that of the filament yarn of the centrifugal spinning made from a cotton linter, and was almost comparable as that of the filament yarn of the continuous spinning. Elongation was a little bit larger than that of the centrifugal spinning and the boiling water contraction was comparable with that of the centrifugal spinning. In the colorimetry of the yarn color, lightness was practically equal, although the filament made from bamboo was rich in yellow tone and the filament made from cotton linter was rich in blue tone. The obtained two multifilament yarns of continuously spun and taken into cakes made from bamboo and cotton linter were served for woven fabric preparations.

The test conditions are as follows.

The warp was subjected to middle twist of 1,000 T/M by a double twister, to vacuum steam twist set at 70° C. for 30 minutes, to partial warping and supra sequence, and woven by a rapier loom in 3/3 twill construction using various wefts. The obtained gray fabrics were passed to dyeing and finishing process. To observe wet behavior of the fabric in the dyeing process, scouring and relaxation were carried out by changing M/C model partially. The relaxation temperature was 98° C. in all cases. In the case of weft having additional twist, the fabric made of the yarn of Example 1 which was subjected to liquid flow relaxation, showed a large swelling in volume and a large processing contraction. The feeling of the fabric just after relaxation was very dry which is different from conventional rayon yarn, namely, it was a dry touch like that of an acetate. Moreover, the crimp due to structural contraction of the warp and the weft caused by the swelling was notable, and the fabric was very excellent in tenseness and resilience. It is presumed that this is brought about by the fact that, although the multifilament yarn made from bamboo was prepared in the same centrifugal spinning condition as that of the multifilament yarn made from cotton linter, as seen from the difference of characteristics in tensile strength and tensile elongation, the α-cellulose content of bamboo is lower than that of cotton linter and there is a difference in molecular orientation to bring about high swelling in water.

The fabrics of the test Nos. 1, 2 and the comparative one after the liquid flow relaxation, were dyed with a reactive dye, and the finished fabrics were sewed into a bottom (pants) for lady. Compared to the comparative one, No. 1 showed a dry touch and had a tenseness and a natural stretchability of 8 to 10% due to the yarn contraction by swelling. And the appearance of the sewed article was good. On the other hand, No. 2 had a stretchability in weft direction of about 20% and it had a dry touch more elegant than No. 1, and the sewed article had good appearance with an excellent silhouette.

The gray fabrics and their process parameters are shown in Table 2.

Examples 2 to 10 and Comparative Example 3

Using 84 dtex×24 filament bright filament yarn made from bamboo pulp made by the centrifugal spinning method of viscose rayon process and, for comparison, a rayon bright filament yarn made from wood pulp (84 dtex×24 filament), various textiles were prepared. The contents of α-cellulose, β-cellulose and other components of both rayon filaments were determined by the above-mentioned chemical analysis. As a result, the component ratio contained of the filament made from bamboo was α-cellulose 87.5% by weight, β-cellulose 10.6% by weight and other components 1.9% by weight. On the other hand, as for the filament made from wood, it was α-cellulose 90.8% by weight, β-cellulose 9.0% by weight and other components 0.2% by weight.

Examples 2 and 3, used 84 dtex-24 filament made from bamboo as warp and, without combining with other yarn and without additionally twisting, subjected to sizing and warping and set to a rapier loom. A fabric in which, as weft, (A) the yarn used in the warp (Example 2) is used, and a fabric in which, as weft, (B) a composite yarn, in which a crimped conjugate fiber yarn (56 dtex-24 filament) made by a bimetal type composite spinning of PET/PPT (polyethylene terephthalate/polytrimethylene terephthalate) was doubled with the yarn used in the warp and intersection twisted, was used (plain habutae and twill habutae, Example 3), were made and subjected to dyeing and finishing.

In the case of a woven fabric of conventional rayon filament yarn in which the warp is not additionally twisted, a slimy touch is its general image, but the fabric made of the filament made from bamboo has a slimy touch which is relatively dry, and was a woven fabric of a novel feeling. The woven fabric was sewed into a shirt. An article with a high quality feeling having a fresh dry touch was obtained.

In Examples 4 and 5, as warps, filament made from bamboo (84 dtex-24 filament) additionally twisted in S and Z directions, respectively, were warped alternatively and wound on a warp beam and set to a loom. A fabric in which, as weft, (A) the highly twisted yarn used as the warp is used, and a fabric in which, as weft, (B) a composite yarns, in which a crimped conjugate fiber yarn (56 dtex-24 filament) made by a bimetal type composite spinning of PET/PPT was doubled with the yarn used as the warp and twisted in S and Z directions, respectively, in the twist number of 1,500 T/M by a double-twister and each two of them was used alternatively to thereby obtain union clothes (plain georgette and crepe georgette) and the clothes subjected to dyeing and finishing.

Dyeing and finishing was carried out to the fabric (example 4) of the usual plane finishing, and to the fabric (example 5) with the surface change by tumbler drying.

In the tumbler dried fabrics, the fabric in which PET/PPT crimped conjugate yarn was used as the weft showed an excellent surface change, and had dry and light touch with excellent stretchability. Regarding the feeling of the finished fabrics, both of them had relatively dry touch with excellent stretchability, tenseness and resilience, which is different from the feeling of conventional rayon woven fabric. As the result of sewing them into dresses, articles excellent in drapability and appearance were obtained.

Example 11

The test yarn of Example 1, 120 dtex-30 filament yarn made from bamboo was used as weft, and a beam of a regular polyester filament (56T-36 filament) of triangular cross sectioned bright yarn having a low twist of 200 T/M and sized, was set to a air jet loom as warp. The cake of the test yarn was rewound by a cone winder for filament and additionally twisted in S and Z directions in the twist number of 1,300. A plain weave was made by alternatively filling the S and Z additionally twisted yarns. In the gray fabric, the woven density was 167 warp yarns/2.5 cm and 82 weft yarns/2.5 cm. Next, as a dyeing process, the fabric was subjected to scouring and relaxation at a condition of 50 to 98° C. by an open cloth type scouring and relaxation machine, the open soaper, and after pre-set by dry heat tenter at 180° C., 15% weight reduction of polyester by alkali in wince type M/C with caustic soda with an amine-based reduction accelerator was carried out, and, by a liquid flow dyeing M/C, dyed only the cellulose side in very light color with a reactive dye. The densities of the warp and weft of the obtained fabric were 176×97 yarns/2.5 cm, respectively. As a result of evaluation of the finished fabric, in warp and weft directions, dimensional contraction by 180° C. dry heat was −0.5% and −1.5% respectively, tear strength was 1,359 g and 750 g, respectively, seam displacement was 0.8 mm and 0.5 mm, respectively, snagging was grade 4 and grade 4, respectively, pilling according to JIS 1076 method (ART method, the method by appearance retention type tester) was grade 4 to 5. All of these are qualities which can pass the application standard for linings of juban (underwear of kimono), susoyoke (a lining of kimono), etc. Moreover, ΔMR, a barometer of feeling at the time of wear, was 5.2, contrary to regular polyester which absorbs almost no moisture, and the touch of the test fabric had cold feeling which may be due to the moisture absorption effect, and has a light and dry touch. Compared to the touch of the conventional rayon which is slimy, the touch of this test fabric was somewhat similar to that of acetate rather than to that of rayon, and it was different from that of viscose type. The result of measurement of negative ions showed that the number of negative ions was 6000 ions/cc and the number of plus ion was 1,000 ions/cc.

Example 12 and Comparative Example 4

Using the test yarn of Example 1, 120 dtex-30 filament, a woven fabric by pre-dyed yarn was prepared. The test yarn, after an additional twisting of 200 T/M, wound on a soft wide cheese and subjected to a cheese dyeing with a reactive dye. As the warp, a polyester dyed yarn of semi-dull 56T-24 filament of round cross section was warped and the dyed yarn was filled as the weft by an air-jet loom and a plain weave with check design of beige, red and black was made. In the dyeing process, the plain weave was subjected to scouring, relaxation, set, drying, treatment of a finishing agent and final set to thereby make a woven fabric for lining application. The quality feeling of the fabric was, being different from that of polyester 100%, light and dry with a cold feeling. Compared to a lining of the almost same design in which a Bemberg filament is used, unlike the Bemberg lining which is very slippery and a little bit slimy, the fabric of this test had a touch excellent in fresh feeling.

Regarding absorption/desorption property, it was excellent as Δ6.3%, the frictional electrification voltage was 0 which indicates an excellent antistaticity.

Example 13

The test filament 130T-30F of Example 1 was set to a creel of a warping machine, and wound on a beam of 30 cm width and set to a tricot machine. A mesh construction was knitted with total warp of 4,212 yarns and front and back reeds with the test filament having no twist. The width of the gray fabric was 254 cm, well 28 W/25 cm, course 41 W/25 cm, 150 racks, weight 14.2 kg. Next, the fabric was passed to a dyeing processes. The processes were constituted by set of the gray fabric, dyeing, drying, resin processing, final set and the finished fabric had structural parameters of 247 cm width, well 28 W/2.5 cm, course 42 W/2.5 cm. The finished fabric had a dry and fresh cold feeling and suitable for linings of summer wares.

Example 14 and Comparative Example 5

A pulp made from bamboo was refined again, and a viscose spinning solution was prepared by the process for making viscose rayon from wood pulp or cotton linter, and a bright yarn of 84 dtex×24 filament was made by, as the spinning method, centrifugal spinning (cake winding) and by continuous spinning method (cheese winding). The cake was scoured in the following process and rewound on a cone by a rewinder. The weight of single cake was set to 550 g and the weight of single cheese of continuous spinning was set to 1 kg. The quality of the raw yarn for woven or knitted fabric needs uniformity. In the case of a viscose process filament made from bamboo, compared to conventional raw yarn made from wood pulp, there is an inclination that the content of α-cellulose component is low and the content of β-cellulose and other low molecular weight component is high. That is, because its crystallinity is low and the content of amorphous portion is high to check whether there is no problem in level dyeing, concerning the difference of inner and outer layers of package or the difference between spinning machines, respective yarns were continuously filled as weft, and then the gray fabric was dyed in a same batch. Dyeing and finishing were carried out by a high pressure liquid flow dyeing machine in one bath two step dyeing with a disperse dye 0.3% owf and a direct dye 0.15% owf (both were blue), the bath ratio 1:10 and the dyeing temperature 130 to 90° C. After final set, by checking the fabric by visual inspection and by the difference of E value, ΔE*a*b*, according to L*a*b* color-coordinate-system measurement by spectral colorimeter, the difference between inner and outer layers of cake, the difference of inner and outer layers between cakes (spinning machines), the difference between inner and outer layers of the cheeses of continuous spinning and difference of inner and outer layers between cheeses (spindles) were measured and compared. The colorimetry is carried out by spectral colorimeter CM-3600 of MINORUTAKONIKA Sensing Co. Ltd. and with light source D65.

As a result of the colorimetry, every cake yarn exhibited dyed color difference, ΔE, far larger than the acceptable value, 0.5, which difference was a level capable of realizing by visual inspection of the fabric, and it was necessary to use separately, as warp, the inner and outer layers. On the other hand, the ΔE value of the continuous spinning yarn of between inner and outer layers of cheese and the difference between cheeses were in the range of 0.5 or less, and it was confirmed that it is a quality which could be reliably used.

Example 15

Using a bright yarn of 84 dtex-24 filament made from bamboo and made by continuous spinning of viscose process of Example 14, and a doubled and twisted yarn of a bright yarn of 84 dtex-36 filament of polylactic acid fiber filament with a number of twist of 1,000 T/M in S direction, as the warp and the weft, respectively, and a woven fabric of plain construction was made by a rapier loom. Dyeing and finishing were carried out according to the general conditions for ordinary viscose rayon woven fabric except the condition for imparting natural wrinkle to the fabric beforehand. Dyeing was carried out with a disperse dye at 110° C. and with a reactive dye at 80° C. The fabric obtained was finished so that no iron is necessary in view of the iron-proof property of the polylactic acid fiber. The appearance matched the quality feeling of cellulose-based fiber made from bamboo, with a natural feeling and very dry touch, and a fabric having a quality feeling capable of applying to summer wares was obtained. The fabric is expected, from the ecological combination, as a material which is effective to prevent environmental pollution in the future, because it is constituted of cellulose-based fiber made from bamboo and the polylactic acid fiber made from corn, and combustion energy and the $CO_2$ generation can be decreased. In addition, as a result of measurement of absorption/desorption property, ΔMR was 4.5 which means that 50% use of the cellulose-based fiber corresponds to the effect of cotton, thus, it is a material suitable for spring/summer wares.

Example 16

Using a part of the cake yarn of viscose process filament made of bamboo and continuous spinning yarn used in Example 14, composite yarns, by a composite false twisting process with different feeding speeds, with a thick-and-thin yarn of semi-dull type polyester filament of 84 dtex-36 filament were prepared. The composite false twisting process was conducted according to the publicly known method disclosed in JP-B-59-26989, "A false twisted composite highly twisted yarn and a method making thereof". As the false twisting machine with two feeding portions, spindle type false twister 103 made by Toshiba Machine Co., Ltd. with first and second heaters was used. The conditions were set to, false twisting spindle rotation speed, 110,000 rpm; number of false twisting, 2,570 T/M; over-feed ratio of covering yarn to core yarn, 90%; first and second heater temperatures, 175° C. and 185° C., respectively. As the feed yarns, for the core yarn of the composite false twisted yarn, the polyester thick-and-thin yarn was used, and for the sheath yarn which constitutes a slub yarn having singly folded portions and triply folded portions, the cellulose-based filament made from bamboo was used. Process conditions suitable for the cake yarn and the continuous spinning yarn in the false twisting process was tested. It was found that the factor which is most important to improve processability and configuration stability of the yarn, namely the condition for the sheath yarn to entangle to the core yarn firmly when overfed and make it possible to maintain its configuration when used as warp in weaving stage is that it is necessary to additionally twist the sheath yarn. It was also found that the number of additional twists should be larger for the continuous spinning yarn than for the cake yarn. The number of the additional twist for the cake yarn was 200 T/M and for the continuous spinning yarn was 350 T/M. It is believed that, at entangling to the core yarn, the multifilament yarn of continuous spinning lacks unity. At spinning of the cake yarn, an original twist is imparted to the filament yarn by rotation of pot when wound.

The obtained two types of the composite false twisted yarn were used as warp and weft, respectively, and a plain woven fabric and a twill woven fabric were prepared and dyed and finished. The woven fabrics obtained were sewed into a gauze-like and haori type spring/summer jacket. As a result, the filament yarn made from bamboo constitutes most of the surface of the fabric and it was a fabric having a high quality feeling of dry touch and a good surface appearance. The absorption/desorption properties, ΔMR, of both of the fabrics, were level 7, which is far larger than 4% of cotton, and it was recognizable at the time of wear. In addition, regarding antibacterial property, although it cannot be achieved entirely by conventional rayon product due to also the influence of false twisting, it was 1.7 in the fabric, according to the united evaluation method of SEK. Although 1.7 was under the passable level, by MAKSPEC process to impart an antibacterial component at dyeing which is a processing technology of Toray Industries at dyeing and finishing process, the fabric could clear the SEK standard, 2.2 or more, after 20 times washing.

TABLE 1

| | | | Example 1 | | | Comparative example | | | |
|---|---|---|---|---|---|---|---|---|---|
| | | | Test yarn 135 dtex-30F (centrifugal spinning) | | | 1 Yarn for comparison 120 dtex-30F (same as left) | | | 2 Yarn for comparison (continuous spinning) |
| | | | Outer layer | Middle layer | Inner layer | Outer layer | Middle layer | Inner layer | — |
| Apparent yarn thickness | | (dtex) | 137.4 | 140.3 | 141.3 | 129.0 | 130.8 | 132.9 | 83.9 |
| Tensile | Strength | (cN) | 209.8 | 212.1 | 210.8 | 264.4 | 261.4 | 262.1 | 136.3 |
| | Elongation | (%) | 21.4 | 25.3 | 25.7 | 18.7 | 20.6 | 20.6 | 20.8 |
| Boiling water contraction | | (%) | 0.7 | 0.0 | 0.0 | 1.5 | 0.8 | 0.3 | 5.2 |
| Dry heat | 120° | (%) | 0.4 | 0.4 | 0.3 | 0.4 | 0.3 | 0.3 | 0.9 |
| contraction | 160° C. | | 0.6 | 0.7 | 0.6 | 0.5 | 0.5 | 0.3 | 0.9 |
| | 180° C. | | 0.8 | 0.9 | 0.7 | 0.4 | 0.5 | 0.5 | 0.9 |

TABLE 1-continued

| | | Example 1 | | | Comparative example | | | |
|---|---|---|---|---|---|---|---|---|
| | | Test yarn 135 dtex-30F (centrifugal spinning) | | | 1 Yarn for comparison 120 dtex-30F | | | 2 Yarn for comparison |
| | | | Middle | Inner | (same as left) | | | (continuous spinning) |
| | | Outer layer | layer | layer | Outer layer | Middle layer | Inner layer | — |
| Colorimetry | L value | 88.52 | 87.74 | 87.80 | 89.69 | 89.77 | 89.77 | — |
| | a value | −3.78 | −4.12 | −4.05 | −9.36 | −9.19 | −8.18 | — |
| | b value | 8.05 | 8.16 | 8.48 | 0.36 | 0.65 | 0.76 | — |

* Measurements are based on JIS L1013 "Chemical fiber filament yarn test method"

* However, colorimetry is conducted by densely distributed filament yarn on a flat aluminum plate, and L (lightness), a value (+ reddish, − bluish) and b value (+ yellowish, − bluish) were determined.

TABLE 2

| | | | Example 1 | | | | | |
|---|---|---|---|---|---|---|---|---|
| | | | 1 | 2 | 3 | 4 | 5 | Co. example 1 |
| Warp | Yarn used | | 130 dtex-30F | | | | | 120 dtex-30F |
| | Number of additional twist (T/M) | | 1,000 | | | | | |
| Weft | Yarn used | | same as warp | PTT/PEP conjugate 56T-24/2 | cotton yarn 60/2 | same as warp | | |
| | Number of additional twist (T/M) | | 1,000 | | — | 0 | 1,000 | |
| Gray fabric | Width (cm) × Length (m) | | 133 × 52 | 129 × 52 | 131 × 52 | 147 × 136 | 143 × 127 | 141 × 12 |
| | Warp × Weft densities (yarns/2.5 cm) | | 157 × 88 | 162 × 90 | 160 × 78 | 196 × 100 | 200 × 94 | 204 × 110 |
| | Construction | | 3/3 twill | 3/3 twill | 3/3 twill | 3/3 twill | 3/3 twill | 3/3 twill |
| Relaxation | Liquid flow method | Width (cm) | 115 | 89 | 123 | 125 | 95 | 120 |
| | | Width contraction (%) | 13.5 | 31.0 | 6.5 | 14.9 | 32.8 | 14.8 |
| | | Yarn density (%) | 108 | 116 | 85 | 110 | 114 | 120 |
| | | Length contraction | 22.7 | 28.8 | 8.9 | 10.0 | 21.2 | 1.1 |
| | | Touch | dry | dry & stretchable | dry & soft | dry | dry | a little slimy |
| | Open cloth method | Width (cm) | 122 | 95 | 122 | — | — | — |
| | | Width contraction (%) | 8.3 | 26.3 | 6.8 | — | — | — |
| | | Yarn density (%) | 103 | 107 | 80 | — | — | — |
| | | Length contraction | 17.0 | 18.8 | 1.0 | — | — | — |
| | | Touch | dry/light | dry/light & stretchable | dry/light & soft | — | — | — |

TABLE 3

| | | | Example 2 | | Example 3 | | Example 4 | | Example 5 | |
|---|---|---|---|---|---|---|---|---|---|---|
| | | | A | B | A | B | A | B | A | B |
| Warp | Cellulose-based fiber used | | 84T-24F Bright (rayon filament by centrifugal spinning) made from bamboo | | | | | | | |
| | Yarn combined | | — | | | | | | | |
| | Combination method | | — | | | | | | | |
| | Total thickness (dtex) | | — | | | | | | | |
| | Cellulose-based fiber content | | 100 | | | | | | | |
| | Number of additional twist (T/M) | | O (sizing) | | | | S 1,500 | | | |
| Weft | Cellulose-based fiber used | | 84T-24F Bright (rayon filament by centrifugal spinning) made from bamboo | | | | | | | |
| | Yarn combined | | — | 56T-24F*1 | — | 56T-24F*1 | — | 56T-24F*1 | — | 56T-24F*1 |
| | Combination method | | — | D/IT, C | — | D/IT, C | — | D/IT, C | — | D/IT, C |
| | Total thickness (dtex) | | — | 140 | — | 140 | — | | — | |
| | Cellulose-based fiber content | | 100 | 60 | 100 | 60 | 100 | 140 | 100 | 140 |
| | Number of additional twist (T/M) | | 0 | 1,000 | 0 | 1,000 | S, Z 1,500 | 0 | S, Z 1,500 | 0 |
| | | | | | | | | S, Z 1,500 | | S, Z 1,500 |
| Gray fabric | Contraction in labo. (boil × 30 min.) | Length | 17.0 | 23.3 | 14.2 | 22.0 | — | — | — | — |
| | | Width | 5.1 | 11.8 | 5.3 | 11.1 | — | — | — | — |
| | Width (cm) × Length (m) | | 129.5 | 132.4 | 131.5 | 132.0 | 131.0 | 125.0 | 131.0 | 125.0 |
| | Woven density (yarns/2.5 cm) | | 77 | 64 | 96 | 87 | 99 | 104 | 82 | 95 |
| | Woven construction | | plain (habutae) | | twill (habutae) | | plain (chiffon georgette) | | crepe (crepe georgette) | |
| Dyeing | Relaxation | Width (cm) | 122.0 | 105.2 | 122.5 | 106.5 | — | — | — | — |
| | | Weft density (yarns) | 93 | 83 | 118 | 118 | — | — | — | — |
| | Dyeing/finishing | Width (cm) | 116.0 | 98.5 | 114.0 | 100.0 | 94.5 | 84.3 | 94.0 | 76.5 |
| | | Weft density (yarns) | 93 | 83 | 76 | 80 | 80 | 90 | 93 | 99 |

TABLE 3-continued

| | | | Example 2 | | Example 3 | | Example 4 | | Example 5 | |
|---|---|---|---|---|---|---|---|---|---|---|
| | | | A | B | A | B | A | B | A | B |
| Touch | Dry touch | | | | | | Very good | | | |
| | Tenseness, resilience | | | Good | | | | Very good | | |
| | Drapability | | | Good | | | | Very good | | |
| | Stretchability | | | | Good | | | Very good | Good | Very good |
| | Coloration | | Good | average | Good | | | Very good | | |
| Physical properties (JIS L1096) | Dimensional change by washing (F-1 or G method) | Length | −10.9 | −4.8 | −7.0 | −4.8 | −5.6 | −4.2 | 1.1 | −4.6 |
| | | Width | 0.8 | −0.3 | 0.1 | −0.3 | 0.2 | 0.4 | 4.3 | 0.3 |
| | Tear strength (N) (Pendulum method. | Length | 7.2 | 20.8 | 14.6 | 20.8 | 13.5 | 14.7 | 17.3 | 20.3 |
| | | Width | 4.7 | 14.0 | 7.0 | 14.0 | 6.8 | 7.0 | 10.7 | 10.2 |
| | Stretch (%) (1.5 kg · f) | Length | | | | | — | | | |
| | | Width | — | 6.5 | — | 7.8 | 23.0 | 29.5 | 25.5 | 40.5 |

Note)

*1: Multifilament yarn of polyethylene terephthalate 50/polymethylene terephthalate 50 side by side type conjugate fiber

*2: "D/IT, C" denotes "Doubling/intersection twist and Combined weave".

TABLE 4

| | | | Example 6 | Example 7 | Example 8 | Example 9 | Example 10 | Comparative example 3 |
|---|---|---|---|---|---|---|---|---|
| Warp | Cellulose-based fiber used | | 84T-24F Bright (rayon filament by centrifugal spinning) made from bamboo | | | | | 84T-24F Bright (regular rayon filament by centrifugal spinning) made from wood pulp |
| | Yarn combined | | — | PU 44*3 | | — | PET 33T-12F | — |
| | Combination method | | Doubling and twisting | W covering | | Doubling and twisting | Filament mixing + additional twisting | Doubling and twisting |
| | Total thickness (dtex) | | 168 | 182 | | 168 | 117 | 168 |
| | Cellulose-based fiber content | | 100 | 92 | | 100 | 72 | 100 |
| | Number of additional twist (T/M) | | S, Z 1,200 | | S, Z 800 | | S 1,000 | S 800 |
| Weft | Cellulose-based fiber used | | 84T-24F Bright (rayon filament by centrifugal spinning) made from bamboo | | | | | |
| | Yarn combined | | | PU 44*3 | | | 56T-24F/2*1 | |
| | Combination method | | Single covering/combined weave | Same as warp/combined weave | | Doubling and twisting/combined weave | | |
| | Total thickness (dtex) | | | 182 | | | 112 | |
| | Cellulose-based fiber content | | | 92.3 | | | 0 | |
| | Number of additional twist (T/M) | | | S 800 | | | S 1000 | |
| Gray fabric | Contraction in labo. (boil × 30 min.) | Length | 12.1 | 40.5 | 40.0 | 10.9 | 13.4 | 6.5 |
| | | Width | 36.5 | 33.6 | 36.3 | 13.1 | 20.0 | 8.3 |
| | Width (cm) × Length (m) | | 191 × 29.7 | 177 × 57.0 | 180.0 × 57.0 | 144.7 × 27.0 | 144.5 × 25.9 | 144.0 × 26.0 |
| | Warp × weft density (yarns/2.5 cm) | | 84 | 65 | 87 | 96 | 89 | 95 |
| | Woven construction | | venetian | tromat | 2/2 twill | 3/2 twill | | |
| Dyeing | Relaxation | Width (cm) | 120.0 | 108.0 | 107.5 | 119.0 | 103.5 | 121.0 |
| | | Weft density (yarns) | 94 | 89 | 120 | 109 | 100 | 105 |
| | Dyeing/finishing | Width (cm) | 126.5 | 106.0 | 105.6 | 112.0 | 106.0 | 116 |
| | | Weft density (yarns) | 101 | 91 | 113 | 116 | 110 | 110 |
| Touch | Dry touch | | Very good | | Good | Very good | | Good |
| | Tenseness, resilience | | | Good | | Very good | | Good |
| | Drapability | | Good | | average | Very good | | Good |
| | Stretchability | | | Very good | | | Good | Average |
| | Coloration | | | Good | | Very good | Good | Very good |
| Physical properties (JIS L1096) | Dimensional change by washing (F-1 or G method) | Length | −0.6 | −5.4 | −5.5 | −0.8 | −0.6 | −1.2 |
| | | Width | 1.2 | 0.4 | −0.6 | 0.5 | 0.9 | 1.1 |
| | Tear strength (N) (Pendulum method. | Length | 31.4 | 29.8 | 28.2 | 31.4 | 31.4 | 32.5 |
| | | Width | 11.1 | 23.4 | 26.3 | 27.4 | 17.6 | 29.0 |

TABLE 4-continued

| | | Example 6 | Example 7 | Example 8 | Example 9 | Example 10 | Comparative example 3 |
|---|---|---|---|---|---|---|---|
| Stretch (%) | Length | 9.0 | 35.3 | 41.3 | 10.3 | — | 5.2 |
| (1.5 kg · f) | Width | 39.5 | 56.5 | 56.0 | 10.3 | 14.5 | 4.5 |

(Note)
*3: As PU 44T, "Lycra T 127C" made by Opelontex Co., Ltd. was used in draft ratio of 3.0.

TABLE 5

| | Yarn to be evaluated | | | |
|---|---|---|---|---|
| | Cake yarn made from bamboo | | Continuous spinning yarn made from bamboo | |
| Sample No | Dyeing difference in cake | Dyeing difference between cakes | Dyeing difference in cheese | Dyeing difference between cheeses |
| 1 Inner layer | 1.46 | out/out 1.4 | 0.5 | out/out 0.21 |
| Outer layer | | in/in 1.16 | | in/in 0.21 |
| 2 Inner layer | 0.86 | | 0.41 | |
| Outer layer | | | | |
| 3 Inner layer | 0.81 | out/out 0.75 | 0.45 | out/out 0.35 |
| Outer layer | | in/in 0.61 | | in/in 0.5 |
| 4 Inner layer | 0.31 | | 0.17 | |
| Outer layer | | | | |
| 5 Inner layer | 1.14 | out/out 0.74 | 0.37 | out/out 0.25 |
| Outer layer | | in/in 1.59 | | in/in 0.08 |
| 6 Inner layer | 1.32 | | 0.05 | |
| Outer layer | | | | |
| 7 Inner layer | 1.13 | out/out 1.11 | 0.38 | out/out 0.16 |
| Outer layer | | in/in 1.47 | | in/in 0.45 |
| 8 Inner layer | 0.97 | | 0.38 | |
| Outer layer | | | | |
| 9 Inner layer | 1.35 | out/out 1.37 | 0.19 | out/out 0.32 |
| Outer layer | | in/in 0.58 | | in/in 0.32 |
| 10 Inner layer | 1.0 | | 0.21 | |
| Outer layer | | | | |
| 11 Inner layer | 1.12 | | 0.40 | |
| Outer layer | | | | |

Note:
Warp: 56 dtex-36 filament round cross section bright yarn of regular polyester
Weft: 1) Bright yarn of 84 dtex-24 filament made from bamboo made by viscose process centrifugal spinning
2) Bright yarn of 84 dtex-24 filament made from bamboo made by continuous spinning
Weaving: The cake (wound weight 550 g) for the weft 1) was rewound on cones as weft. 11 cones (cake) were continuously filled by air jet loom in one unit. 11 cheeses (wound weight 1 kg) for the weft 2) were continuously filled. Weaving construction was plain (taffeta).
Dyeing: The standard process of taffeta for lining was carried out (open cloth scouring/relaxation - dry heat pre-set - beam dyeing - final set). A reactive dye (%) was used.

The invention claimed is:

1. A fiber yarn which is a yarn containing a bamboo pulp filament having about 80 wt % to about 87.5 wt % of an α-cellulose component and having a thickness of about 10 to about 600 dtex and number of twist of 0 to about 3,000 T/M.

2. The fiber yarn according to claim 1, wherein the filament is 85 wt % to 87.5% wt % of α-cellulose component.

3. The fiber yarn according to claim 1, wherein a total amount of α- and β-cellulose component in said filament is about 90 wt % or more.

4. The fiber yarn according to claim 1, wherein the filament is produced by a continuous spinning system of viscose rayon process.

5. The fiber yarn according to claim 1, wherein the fiber yarn contains at least about 20 wt % of said filament and another fiber that is at least one fiber selected from the group consisting of natural fiber, regenerated fiber, semi-synthetic fiber and synthetic fiber.

6. The fiber yarn according to claim 5, wherein the filament and the another fiber are made into a composite by any one method selected from the group consisting of doubling and twisting, covering, filament mixing, false twisting and spinning intersection twist.

7. A cloth comprising a woven or knitted fabric or a non-woven fabric comprising the fiber yarn according to claim 1.

8. The fiber yarn according to claim 1, wherein the filament is 87 wt % or more of α-cellulose component.

* * * * *